US005546715A

United States Patent [19]

Edstrom

[11] Patent Number: 5,546,715

[45] Date of Patent: Aug. 20, 1996

[54] FABRICATED JAMB OR THE LIKE

[76] Inventor: Melvin G. Edstrom, 13617 - 56th Ave. NE., Marysville, Wash. 98271

[21] Appl. No.: 257,249

[22] Filed: Jun. 8, 1994

[51] Int. Cl.[6] ..... E06B 1/52; E06B 1/08

[52] U.S. Cl. ..... 52/215; 49/504; 52/656.4; 52/730.3; 52/730.7

[58] Field of Search ..... 52/204.1, 204.2, 52/210, 211, 212, 215, 204.53, 204.54, 716.1, 717.01, 717.02, 717.04, 718.01, DIG. 8, 730.3, 730.7, 213, 656.2, 656.4; 49/504, 505; 156/63, 71, 293, 304.1

[56] References Cited

U.S. PATENT DOCUMENTS

| | | | |
|---|---|---|---|
| 598,437 | 2/1898 | Piver | 52/730.7 |
| 2,292,301 | 8/1942 | Smith | 52/210 |
| 3,082,490 | 3/1963 | Loucks | 49/504 |
| 3,119,156 | 1/1964 | Salter, Jr. | 52/211 |
| 3,835,606 | 9/1974 | Liberman | 52/506.07 |

FOREIGN PATENT DOCUMENTS

| | | | |
|---|---|---|---|
| 1509258 | 12/1968 | Germany | 49/505 |
| 64139 | 4/1949 | Netherlands | 52/212 |
| 312574 | 3/1956 | Switzerland | 52/716.1 |
| 2012848 | 8/1979 | United Kingdom | 49/505 |

*Primary Examiner*—Michael Safavi
*Attorney, Agent, or Firm*—Robert W. Beach

[57] ABSTRACT

In a fabricated door jamb, the opposite edges of a rib component core of low-grade lumber are faced with strips of high-grade wood, and the face is veneered. Two flange components are fabricated from cores of low-grade lumber, each having one edge finished with a strip of high-grade wood, and their faces are veneered. The flange components are joined to the generally central edge component by tongue-and-groove joints composed of tongues formed on the adjacent edges of the flange components which fit snugly in the grooves in opposite edges of the tongue component, respectively. Each groove is flared and each tongue is tapered complementally so that the tongues fit snugly and wedgingly in the grooves, the tongue-and-groove joints being located so that the backs of the tongue component and of the two flange components are flush and coplanar.

1 Claim, 2 Drawing Sheets

FABRICATED JAMB OR THE LIKE

BACKGROUND OF THE INVENTION

1. Field of the Invention

This invention relates to jambs and the like, such as door jambs and lintels of door frames and window frames.

2. The Problem

In first-class carpentry, it is required that door frames and window frames be made of high grade lumber, usually clear edge grain, and that the jambs and lintels each be made of one piece with the usual rib formed integral with the flange or flanges of the casing or lintel and the rib not be formed separately and nailed to the portion of the jamb or lintel forming the flange or flanges.

Such a jamb or lintel customarily is four inches (10.16 cm) to eight inches (20.32 cm) in width, and the supply of lumber from which to cut such jambs and lintels is scarce and expensive.

Conventionally, in making a jamb or lintel of T shade with a generally central rib on one side, it is necessary to rabbett the opposite edge portions of a board to form the generally central rib, and such rabbetting is very wasteful of high grade lumber.

It is common practice to veneer the face of cores to provide upgraded lumber, but veneering the face of a door jamb is difficult because of the raised rib customarily provided on jambs and lintels which forms one or two reentrant angles. Veneering the face of a jamb or lintel is particularly difficult if the edges of the rib are to be veneered.

SUMMARY OF THE INVENTION

A principal object of the present invention is to provide jambs and lintels which have a rib integral with a side flange or flanges and which have the appearance of being made of high grade lumber.

In accomplishing the foregoing object, it is an object to utilize largely low-grade lumber for fabricating a jamb or the like which will have a finished appearance of being made from high-grade lumber.

A more specific object is to make a jamb or the like of several separate components bonded together.

A still more specific object is to face all exposed surfaces of a fabricated jamb by finishing such surfaces with high-grade facing strips or veneer.

In fabricating a jamb, it is an object to provide the rib portion of the jamb and one or two flange portions of the jamb which are integrated by bonding and by utilization of a joint or joints which are strong, which will locate the components of the jamb structure in precisely the proper relationship to each other, and which will eliminate contamination of the faces of the jamb by adhesive squeezed out of the joints during assembly of the components.

A further object is to enable the components of the jamb to be made and assembled quickly, easily and accurately.

The foregoing objects can be accomplished by fabricating a jamb or the like from a rib component and one or two flange components. The exposed edge of each flange component is faced with a facing strip, and the opposite edges of the rib component are faced with facing strips of high grade. The faces of the flange component or components and the face of the rib component are then veneered. The flange component or components are secured to the adjacent edge or edges of the rib component by tongue-and-groove joints, the grooves of which flare transversely of their lengths, and the tongues are tapered transversely of their lengths complemental to the grooves and of a size to fit snugly in the groove or grooves.

DETAILED DESCRIPTION

Figure 1:
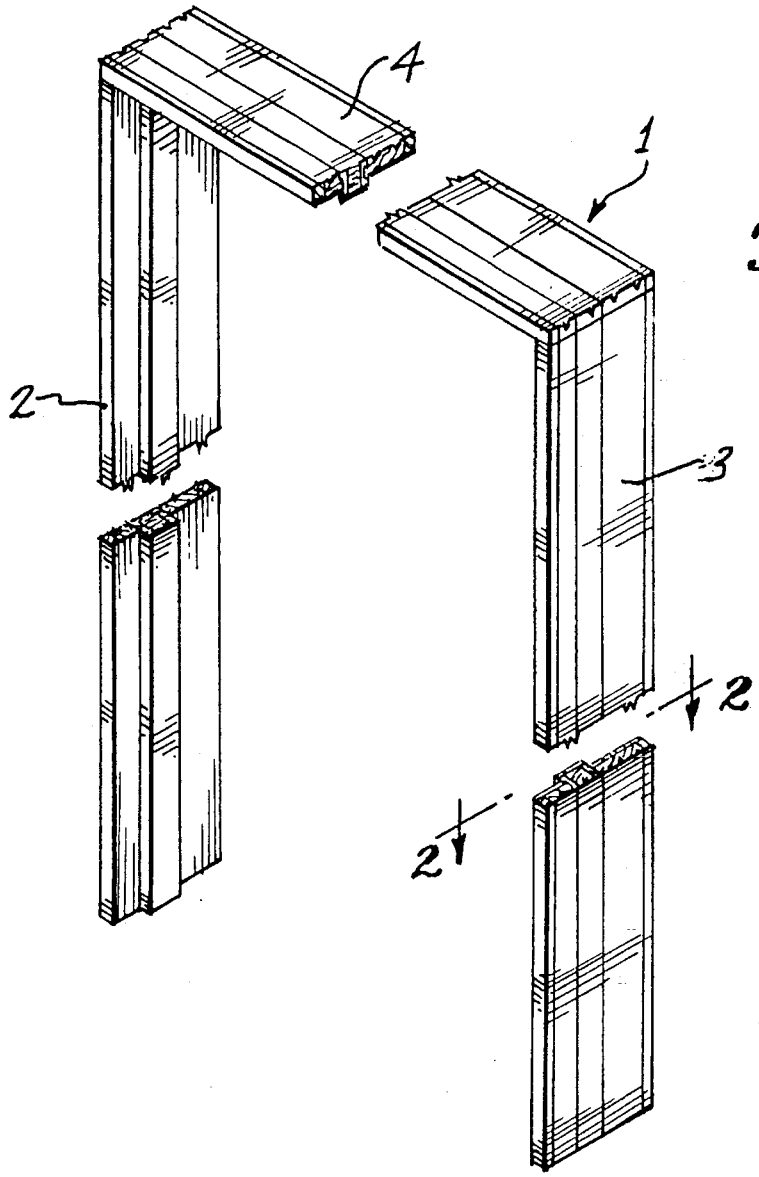
FIG. 1 is a top perspective of a representative door frame assembled from jambs and a lintel fabricated according to the present invention, parts of which are broken away.
Figure 2:
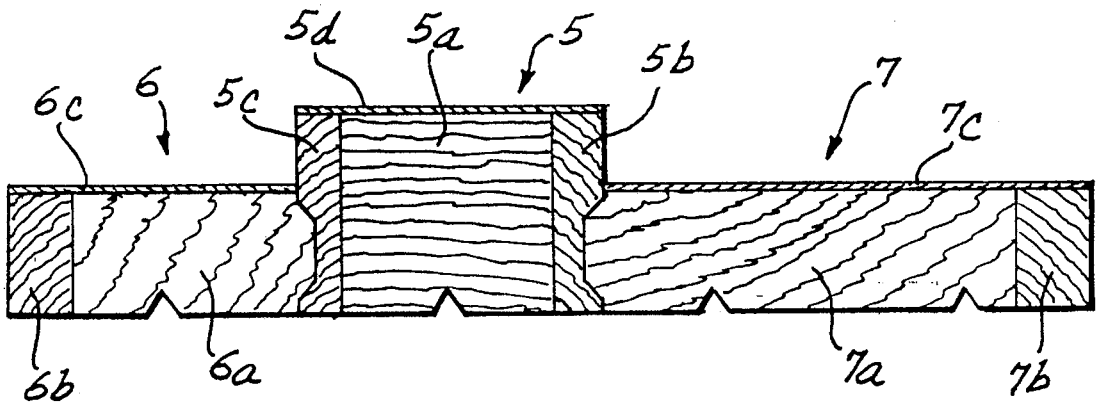
FIG. 2 is an enlarged transverse section through a jamb taken on line 2—2 of FIG. 1.
Figure 3:
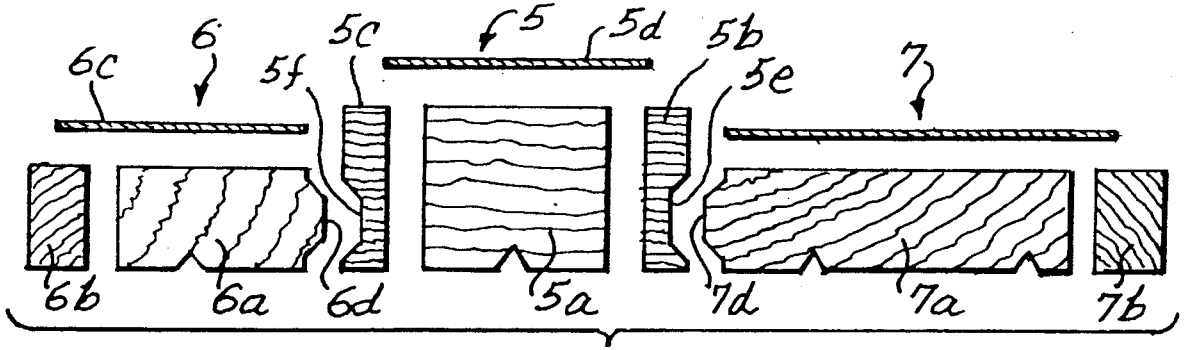
FIG. 3 is a transverse section through the door jamb also taken on line 2—2 of FIG. 1 but showing the parts in exploded relationship.
Figure 4:
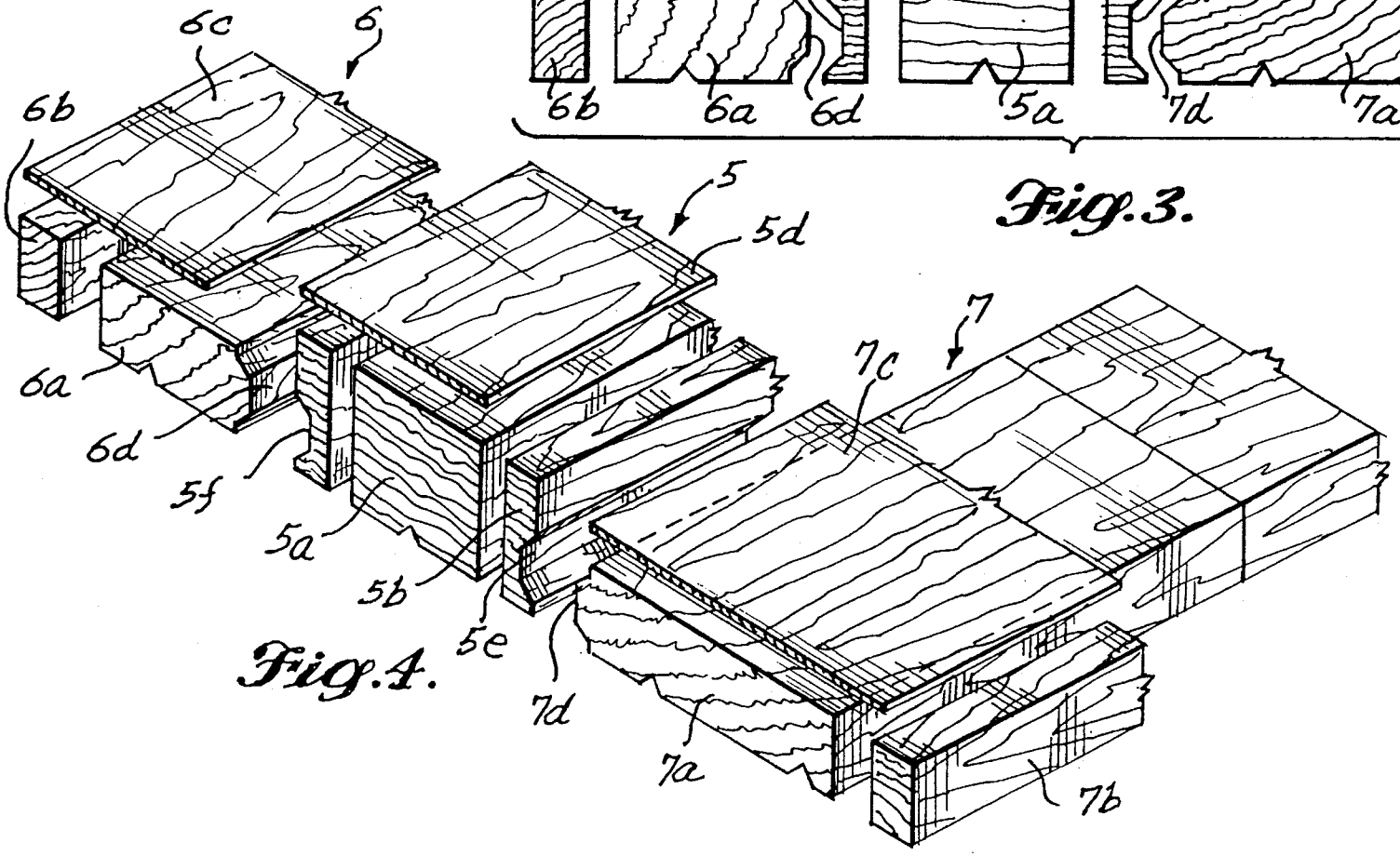
FIG. 4 is a top perspective of a fragment of a jamb also showing parts in exploded relationship.

A representative door frame 1 assembled from door jambs 2 and 3 and a lintel 4 fabricated according to the present invention is shown in FIG. 1. FIGS. 2, 3 and 4 show the fabricated structure of the door jambs and lintel assembled to construct the door frame of FIG. 1.

The jambs and lintel have a generally central rib structure 5 and flange structures 6 and 7 extending oppositely from the rib portion of the jamb. There may be flanges 6 and 7 extending oppositely from the rib 5, or there could be only one flange.

Customarily, the entire jamb is made from high-grade lumber, preferably being clear, i.e., free of knots and pitch pockets, and preferably being edge-grain. The normal procedure for making jambs is to use a clear edge-grain piece of lumber having a width greater than the finished total width of the jamb and a thickness greater than the finished total thickness of the jamb. The opposite edge portions of the board are routed or planed away to reduce the thickness for forming the flanges 6 and 7. Such procedure is very wasteful of high-grade lumber.

The jamb or the like of the present invention is fabricated from lumber which is mostly low grade, which is made possible by fabricating a generally central rib component 5 and side flange components 6 and 7 and integrating these components to form a unitary fabricated jamb. As shown in FIG. 2, the rib component is thicker than the flange components and projects beyond them to form an upstanding door stop.

The rib component 5 is composed principally of a core 5*a* which may be of low-grade lumber. The opposite edges of such core are planed, and finish strips 5*b* and 5*c* of high-grade lumber are bonded to such opposite sides of the core edges as shown in FIG. 3. The face of the rib component is then veneered by bonding to it a layer of veneer 5*d* shown in FIGS. 2, 3 and 4.

After the core component is assembled as shown in FIG. 2, or even before its face has been veneered, tongue-and-groove joint grooves 5*e* and 5*f* are routed or planed in the outer sides flared transversely of their lengths of the finish strips 5*b* and 5*c*, respectively.

One flange component 6 is fabricated from a core 6*a* of low-grade lumber. One edge of this core is finished by bonding to it a finish strip 6*b* of high-grade lumber, preferably clear and having edge grain, and the face of such core and facing strip is veneered up to its edges with finish veneer 6*c* of high quality. The other edge of the core 6 is routed or planed with a molder or molding machine to form a tongue 6*d* tapered transversely of its length of a size and shape complemental to the flared groove 5*f* in one side of the rib component.

While the jamb could be composed of the rib component and only a single flange component, it is preferred that the jamb have an additional flange component 7. This component 7 is fabricated from a core 7*a* of low-grade lumber, one edge of which is finished by bonding to it a finish strip 7*b* of high-grade lumber. The face of the core 7*a* and finish strip 7*b* is then veneered by bonding to it a high-grade veneer sheet 7*c*. Either before or after such veneering, the edge of core 7*a* opposite the finish strip 7*b* is cut with a router or planer, i.e. a molder or molding machine, to form a tongue 7*d* tapered transversely of its length having a size and shape complemental to the flared groove 5*e* in the facing strip 5*b* of the core 5*a* of the rib component 5.

If the fabricated jamb is to have only one flange component, only one groove 5*e* or 5*f* would be cut in an edge of the rib component. If the jamb is to have two flange components, such flange components can be of the same width or of different widths. The jamb can be fabricated according to the desires of a particular customer.

The core 5*a* of the rib component 5, the core 6*a* of the flange component 6, and the core 7*a* of the flange component 7 not only can be made from low-grade lumber but can be made from shorts which are shorter than the length of a jamb 2 and 3 or a lintel 4 and are butt-joined to form a core having the necessary total length for each frame member.

The tongues 6*d* and 7*d* of the tongue-and-groove joints joining the flange components and the rib component are shown as being provided on the unfinished edges of the flange component cores 6*a* and 7*a*. Alternatively, one or both of such core edges could have in it the groove for the tongue-and-groove joint and the complemental tongue of the tongue-and-groove joint could be formed on one or both of the edge-finish strips 5*b* and 5*c* of the rib component, but this construction is not preferred because it would require that the rib component edge-finish strips 5*b* and 5*c* be thicker, which would require larger strips of high-grade lumber. When the tongue-and-groove joint tongues are provided on the edges of the flange component cores 6*a* and 7*a*, on the other hand, the tongues are not made of high-grade lumber.

The weakest part of the fabricated jamb is at the junctions of the flange components with a rib component. To provide a much stronger joint between each flange component and the rib component, a tongue-and-groove joint rather than a butt joint is used. Also, the tongue-and-groove joint is of special shape, the width of the tongue at its root being a plurality of times as great as the thickness of the tongue, preferably from three to four times as great. Also, the tongue-and-groove joints are of special complemental shape, each groove 5*e* and 5*f* being flared transversely of its length and each tongue 6*d* and 7*d* being complementally tapered transversely of its length to fit snugly in the groove when the flange components and rib component are assembled together as shown in FIG. 2.

The degree of flare of the groove edges is preferably such that the angle of such edges relative to the groove bottom is from thirty degrees to sixty degrees and preferably is forty-five degrees. The widths of the tongues 6*d* and 7*d* at their roots are preferably at least one-half of the thickness of the flange component cores 6*a* and 7*a*.

The tongues 6*d* and 7*d* and the grooves 5*e* and 5*f* are located such that, when the tongues are fitted snugly in the grooves, the backs of the flange components 6 and 7 and the back of the rib component 5 will be substantially flush and coplanar, as shown in FIG. 2. The entire width of the tongue-and-groove joint member carried by the rib component 5 will therefore be hidden by the edge portion of the flange component joined to the rib component.

It is important that the adhesive used to join the pieces of the rib component 5 and of the flange components 6 and 7 be strong but preferably thin enough to form simply a film on the tongue-and-groove joint so that the pieces are virtually in contact. A suitable adhesive for this purpose is polyvinyl acetate.

The adhesive film applied to the tongue-and-groove joint or joint components is insufficient to be squeezed out of the joint into the reentrant angle between the face veneer 6*c* or 7*c* of each flange component and the finish pieces 5*b* and 5*c* which form opposite edges of the rib component. Therefore, so that, despite the wedging action of the tapered tongue in the flaring groove of the tongue-and-groove joint, the adhesive will not be squeezed into such reentrant angle, which is difficult to clean. As shown in FIG. 2, despite the great width of the tongue-and-groove components of the tongue-and-groove joint, it will be completely hidden when the flange components have been assembled with the rib component. Also, when the three components are assembled as shown in FIG. 2, both exposed edges of the flange components, the exposed edges of the rib component and the faces of the rib component and of the flange components will be of high-grade lumber to make a first-class jamb or lintel. Also, the strength of the unit will be at least equal to the strength of a jamb or lintel cut from a single piece of high-grade lumber because of the effectiveness of the special tongue-and-groove joints joining the flange components and the rib component. Moreover, because of this special form of tongue-and-groove joint, the back of the composite jamb will be precisely planar, and the flanges will be located accurately relative to the rib. Such accuracy of assembly would be effected by the special tongue-and-groove joint by effecting such assembly in a suitable jig or press. No finishing operation is required after the assembly of the flange components with the rib component has been completed, but the finish strips 6*b* and 7*b* will be sufficiently thick so that the edges of the fabricated jamb can be trimmed on the job to some extent to provide the desired width for custom use.

Actually, a jamb unit fabricated according to the present invention will have less tendency to warp than would a unit cut from a single high-grade lumber board.

I claim:

1. A fabricated jamb or the like comprising a flange component, a rib component thicker than said flange component and arranged in edge-abutting relationship to said flange component with a portion of the thickness of said rib component projecting beyond said flange component, said rib component including a facing strip facing the edge of said rib component adjacent to said flange component, the abutting edge of one of said components having in it a tongue-and-groove joint elongated groove flared transversely of its length and the abutting edge of the other of said components having a tongue-and-groove joint elongated tongue tapered transversely of its length complemental to the flare of said tongue-and-groove joint groove and fitting snugly therein, the width of said tongue-and-groove joint tongue at its root being a plurality of times as great as the thickness of said tongue-and-groove joint tongue, said tongue-and-groove joint groove and said tongue-and-groove joint tongue being bonded together, and said flange component having a veneered face extending to said facing strip said rib component and forming a reentrant angle therewith.

* * * * *

UNITED STATES PATENT AND TRADEMARK OFFICE

CERTIFICATE OF CORRECTION

PATENT NO. : 5,546,715
DATED : August 20, 1996
INVENTOR(S) : Melvin G. Edstrom

It is certified that error appears in the above-indentified patent and that said Letters Patent is hereby corrected as shown below:

Column 4, line 53, after the comma and before "the" insert --and projecting beyond said flange component--.

Column 4, line 65, after "strip" insert --of--.

Signed and Sealed this

Twenty-second Day of October, 1996

Bruce Lehman

*Attest:*

BRUCE LEHMAN

*Attesting Officer*

*Commissioner of Patents and Trademarks*